US005146820A

United States Patent [19]

Nemeth et al.

[11] Patent Number: 5,146,820

[45] Date of Patent: Sep. 15, 1992

[54] PAPER CUTTING APPARATUS AND METHOD

[75] Inventors: Peter Nemeth; Tibor Dancs, both of Aurora; Robert L. Simmons, Lafayette; Istvan Kalman, Westminster, all of Colo.

[73] Assignee: Machine Design Service, Inc., Denver, Colo.

[21] Appl. No.: 697,980

[22] Filed: May 10, 1991

[51] Int. Cl.[5] ..... B26D 1/62

[52] U.S. Cl. ..... 83/37; 83/47; 83/345; 83/674; 241/236

[58] Field of Search ..... 83/343, 674, 345, 37, 83/47, 26, 110; 241/236

[56] References Cited

U.S. PATENT DOCUMENTS

| | | | |
|---|---|---|---|
| 1,716,991 | 6/1929 | Turner | 83/345 X |
| 1,730,449 | 10/1929 | Campbell | 83/345 X |
| 2,836,018 | 5/1958 | Key | 83/27 X |
| 3,084,582 | 4/1963 | Anderson | 83/345 X |
| 3,110,209 | 11/1963 | Takehara | 83/345 X |
| 3,244,049 | 4/1966 | Smith et al. | 83/674 X |
| 3,875,836 | 4/1975 | Hutchinson et al. | 83/47 X |
| 4,830,304 | 5/1989 | Fuke et al. | 242/67.2 |
| 5,024,128 | 6/1991 | Campbell, Jr. | 83/26 |

*Primary Examiner*—Douglas D. Watts
*Assistant Examiner*—Kenneth E. Peterson
*Attorney, Agent, or Firm*—W. Scott Carson

[57] ABSTRACT

The cutting apparatus and method of the present invention involve feeding a newsprint wrapper or any other sheet of paper downwardly along a planar path between two rotating cutters. Each of the cutters includes a planar blade member with an outer, sawtoothed cutting portion. In operation, the blade members are rotated about respective axes to move their cutting portions downwardly along arcuate paths that preferably pass through the path of the downwardly fed sheet. The arcuate paths of the cutting portions overlap and one of the cutting portions of the blade members is spaced farther from its rotational axis than the other. It is also moved tangentially faster about its axis than the cutting portion of the other blade member. In this manner, a cutting action is produced which first punctures and then subsequently tears or shreds a horizontal cut across the downwardly fed sheet to cut it into smaller pieces or segments.

27 Claims, 6 Drawing Sheets

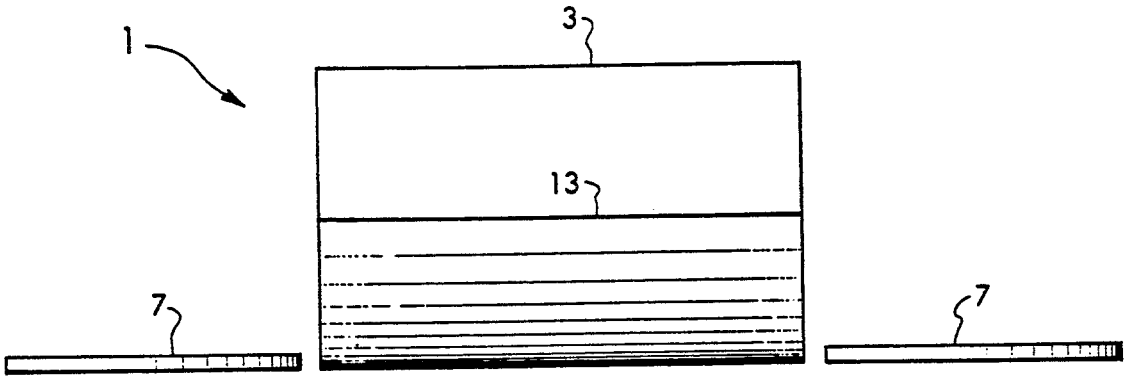
Fig. 4
Fig. 5
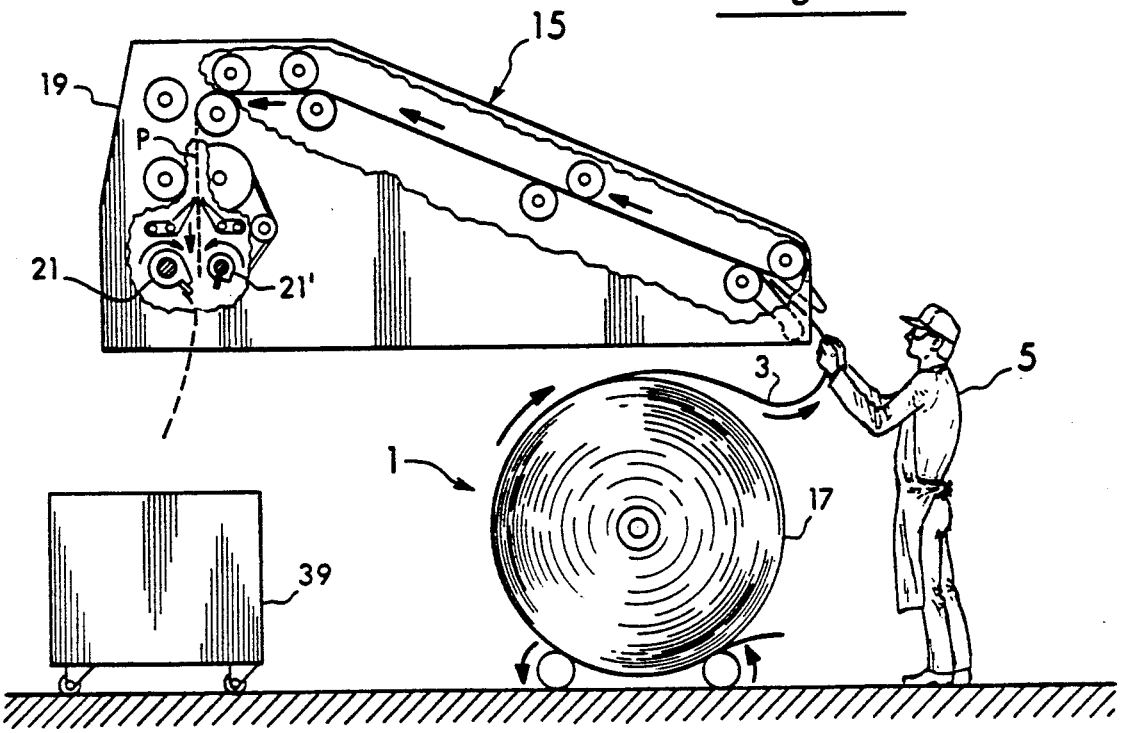

Fig. 14
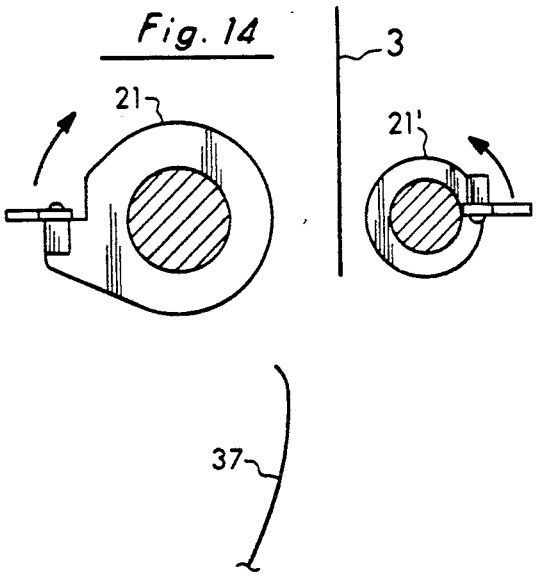
Fig. 17
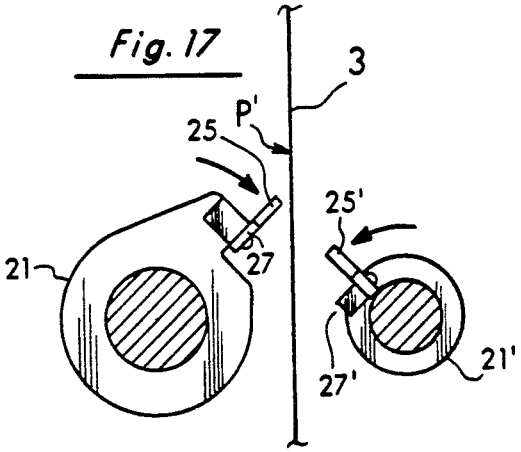
Fig. 15
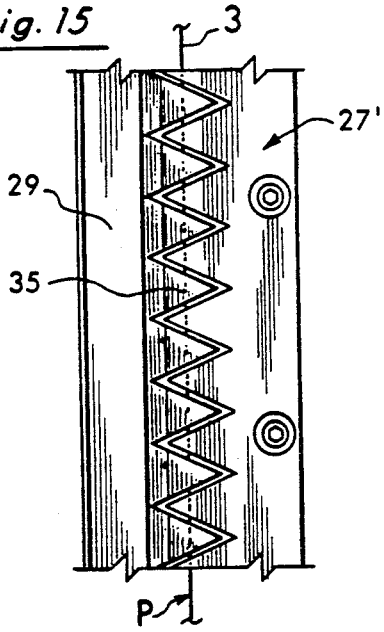
Fig. 18
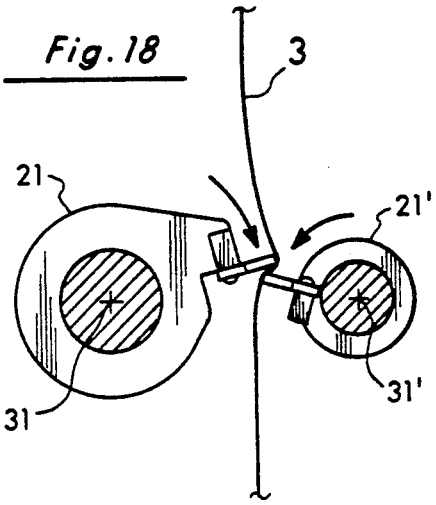
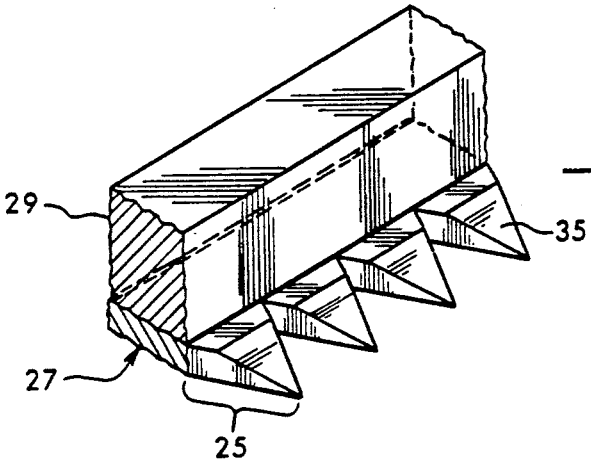
Fig. 16

PAPER CUTTING APPARATUS AND METHOD

BACKGROUND OF THE INVENTION

1. Field Of The Invention

This invention relates to the field of paper cutting apparatus and methods and more particularly, to the field of paper cutting apparatus and methods for newsprint wrappers.

2. Discussion Of The Background

Newsprint for newspapers is commonly delivered in large rolls having a protective, outer sheet or wrapper of heavy paper or cardboard. The rolls are roughly 40–50 inches in diameter and 28–72 inches in width and weigh up to about a ton each. Currently, the most common practice to remove the wrapper is to have an operator manually cut off its end caps with a knife as the newsprint roll is rotated on two smaller conveyor rollers. Once the end caps are removed, the operator next makes a horizontal cut across the wrapper and as the roll continues to be rotated, he manually gathers up the wrapper in his arms to expose the underlying newsprint. Thereafter, the removed wrapper which is in a loose roll or gathering is simply tossed aside and the exposed newsprint is fed into the printers.

Efforts have been made to more quickly and efficiently handle the removal and disposal of the wrapper after it is horizontally cut. To date, these efforts have for the most part simply involved feeding one of the loose ends of the cut wrapper into an overhead conveyor of belt or pinch rollers for quick removal to a remote location. However, even with this arrangement, the removed wrapper still needs to be cut into smaller pieces or segments which can subsequently be bailed and shredded for recycling.

With the above in mind, the new cutting apparatus and method of the present invention were developed. With them, the removed wrapper as well as the end caps can be easily and quickly cut into small pieces or segments that can be easily bailed and shipped for subsequent shredding and recycling.

SUMMARY OF THE INVENTION

The cutting apparatus and method of the present invention involve feeding a newsprint wrapper or any other sheet of paper downwardly along a planar path between two rotating cutters. Each of the cutters includes a planar blade member with an outer, saw-toothed cutting portion. In operation, the blade members are rotated about respective axes to move their cutting portions downwardly along arcuate paths that preferably pass through the path of the downwardly fed sheet. The arcuate paths of the cutting portions overlap and one of the cutting portions of the blade members is spaced farther from its rotational axis than the other. It is also moved tangentially faster about its axis than the cutting portion of the other blade member. In this manner, a cutting action is produced which first punctures and then tears or shreds a horizontal cut across the downwardly fed sheet to cut it into smaller pieces or segments.

More specifically, the cutting action involves having the slower moving cutting portion arrive in the cutting area wherein it contacts and deflects the sheet in a first horizontal direction. At substantially the same time, the other, faster moving cutting portion also arrives in the cutting area and contacts and deflects a trailing part of the sheet in an opposite horizontal direction. The faster moving cutting portion then catches up to and meshes with the slower moving one. In doing so, it causes the teeth of both cutting portions to first puncture the sheet and then subsequently tear or shred the sheet horizontally in two as the cutting portions mesh and pass through one another. The action of the faster moving cutting portion additionally serves to toss or direct the cut paper segment to one side as the cutting portion continues along its path about its rotational axis. The cut pieces or segments of the sheet can then subsequently be easily bailed and shipped for recycling.

BRIEF DESCRIPTION OF THE DRAWINGS

FIG. 4 illustrates a subsequent step in the process of removing the wrapper in which a horizontal cut is made by the operator across the wrapper after both end caps have been removed.

FIG. 5 is a side elevational view illustrating the operator hand feeding the cut wrapper into an overhead conveyor.

FIGS. 7–14 illustrate in sequential steps the preferred mode of operation of the cutting apparatus of the present invention.

FIG. 15 is a view taken along line 15—15 of FIG. 12 showing the manner in which the cutting portions of the blade members overlap or mesh.

FIG. 16 is a perspective view of the cutting portion of one of the blade members.

FIGS. 17–20 illustrate a second mode of operation of the present invention. In it, the sheet to be cut is fed downwardly out of or away from the rotational path of the right cutter in FIG. 17 wherein the left cutter will contact and push the sheet over to the right cutter as shown in FIG. 18. The subsequent cutting action of FIGS. 18–20 then corresponds to that of FIGS. 9–14.

DETAILED DESCRIPTION OF THE PREFERRED EMBODIMENTS

Figure 1:
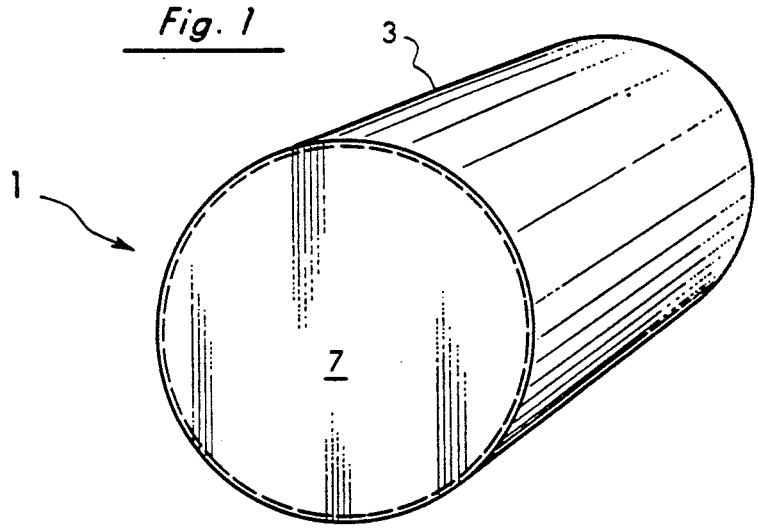
FIG. 1 is a perspective view of a newsprint roll for a newspaper as it is commonly delivered with a protective, outer sheet or wrapper of thick paper or cardboard.

As shown in FIG. 1, newsprint for newspapers typically is delivered in large rolls 1 which have a protective, outer sheet or wrapper 3 of heavy paper or cardboard. The rolls 1 are commonly 40–50 inches in diameter and 28–72 inches in width and weight up to about one ton each.

Figure 2:
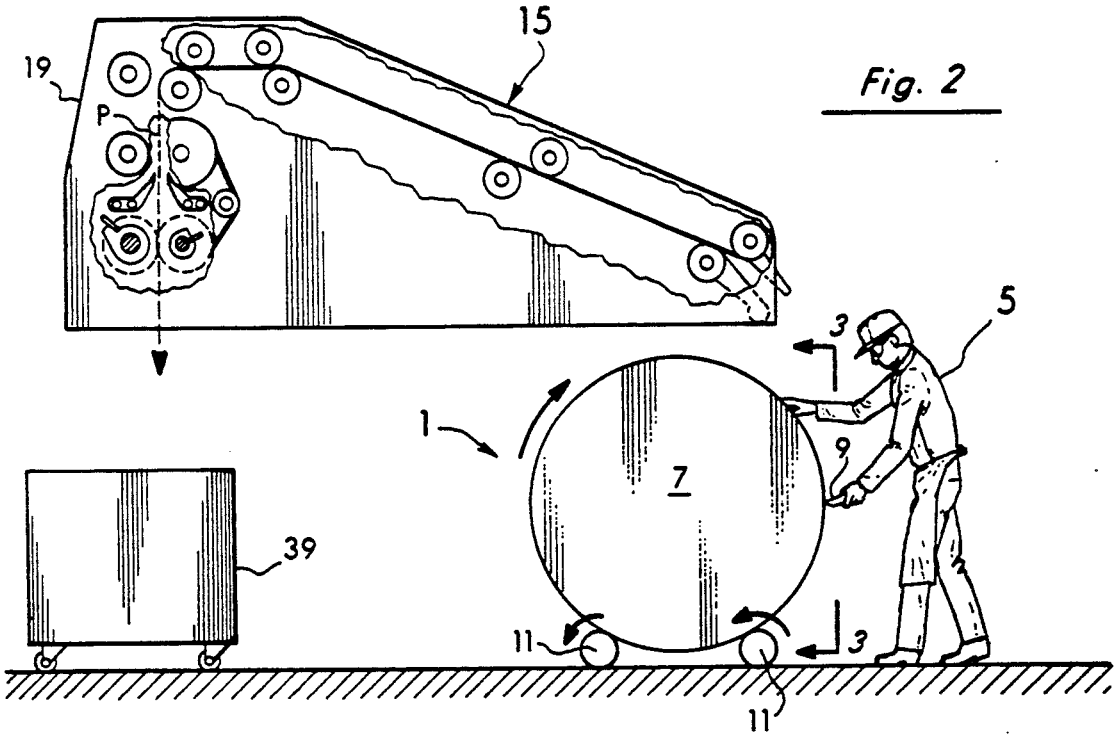
FIG. 2 is a side elevational view of the roll being rotated to permit an operator to manually cut and remove the wrapper to expose the underlying newsprint.
Figure 3:
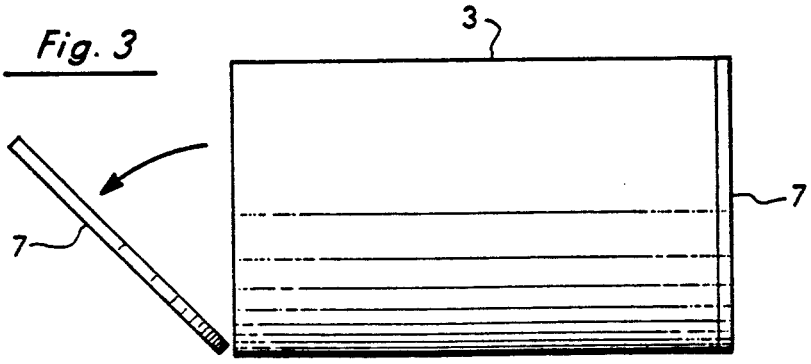
FIG. 3 illustrates a step in the removal of the wrapper in which the end cap of the wrapper is cut away from the roll.

To remove the protective wrapper 3 in preparation for feeding the underlying newsprint to the printers, an operator 5 (see FIG. 2) manually cuts off each end cap 7 with a knife 9 as the newsprint roll 1 is rotated on two smaller conveyor rollers 11. Once the end caps are cut, they simply fall off to each side (see FIGS. 3 and 4). Thereafter, the operator 5 makes a horizontal cut 13 across the wrapper 3 (see FIG. 4) and feeds the loose end of wrapper 3 into an overhead conveyor 15 of belts or pinch rollers as shown in FIG. 5. The exposed newsprint 17 is then fed to the printers.

Figure 6:
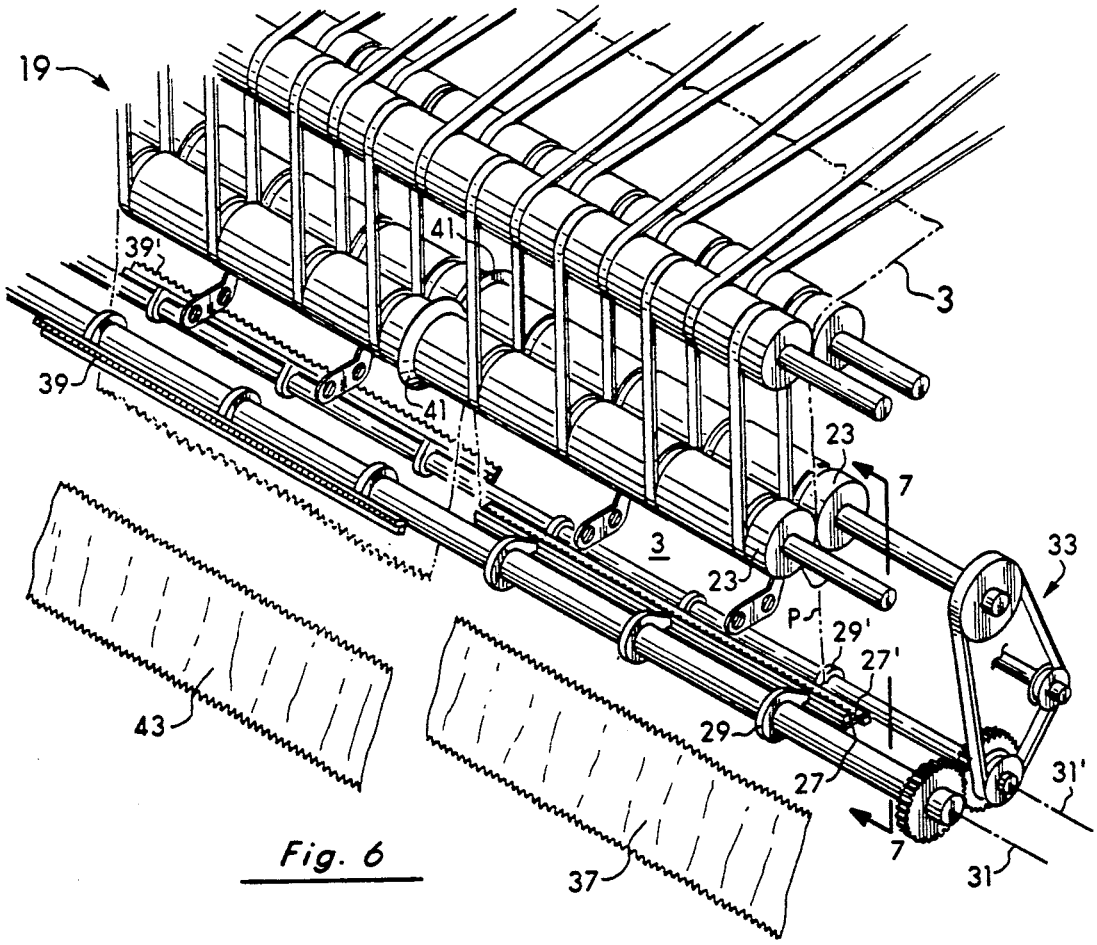
FIG. 6 is an enlarged, perspective view of the discharge end of the overhead conveyor of FIG. 5 showing the cutting structure and method of the present invention.

The cutting apparatus and method of the present invention involve cutting the wrapper or other sheet of paper 3 as it is discharged downwardly from the overhead conveyor 15 at its discharge end 19. As schematically shown in FIG. 5, the wrapper 3 being fed into the conveyor 15 will eventually travel through it and out its discharge end 19 along a vertical planar path P (shown in dotted lines in FIGS. 2 and 5) between the two rotating cutters 21 and 21'. A perspective view of the cutting action at the discharge end 19 of the conveyor 15 is shown in FIG. 6.

Figure 7:
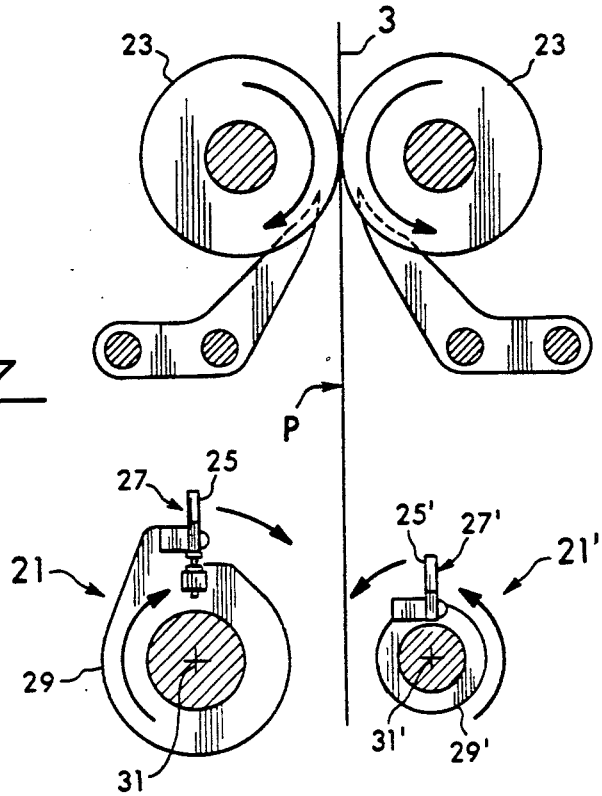
Figure 8:
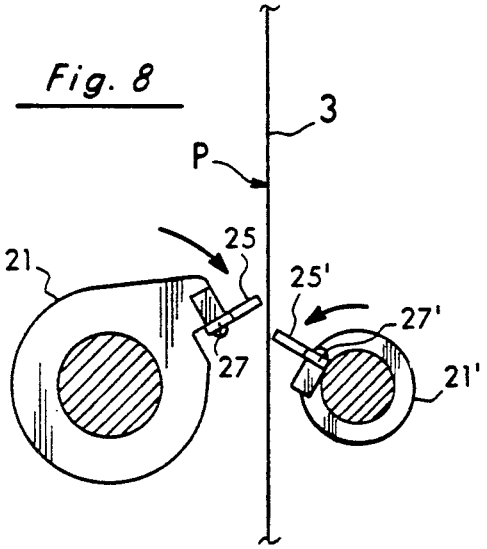
Figure 11:
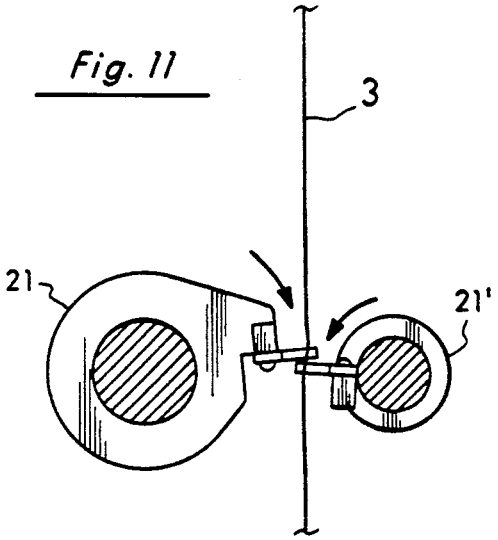
Figure 9:
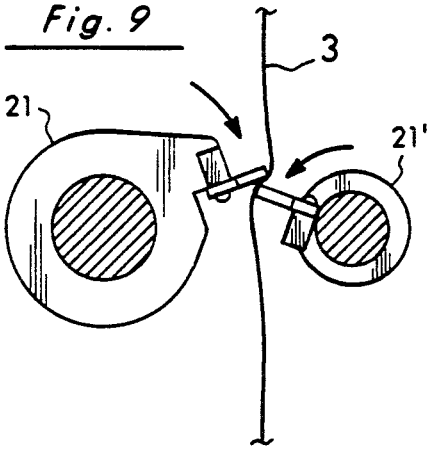

In use as illustrated in FIGS. 7-15, the preferred manner of operation is to have the planar wrapper or other sheet of paper 3 fed vertically downwardly by the rollers 23 of the conveyor 15 substantially along the planar path P (see FIG. 7). The path P preferably passes slightly off center to the right in FIG. 7 between the rotating cutters 21 and 21'. As discussed in more detail below, this off center position is preferably where the cutting portions 25 and 25' of the blade members 27 and 27' will ultimately mesh. Referring again to FIG. 7, the cutters 21 and 21' include the planar blade members 27 and 27' which are mounted on collars 29 and 29' for rotation about their respective axes 31 and 31'. Each blade member 27 and 27' has a sawtoothed cutting portion 25 and 25' (see FIGS. 15 and 16) which are spaced accordingly to allow the cutting portions 25 and 25' to mesh. The blade members 27 and 27' are preferably the same size for convenience of manufacture and replacement. However, the blade member 27 on the left in FIG. 7 is preferably mounted on a larger collar 29 so that its cutting portion 25 is spaced farther from its rotational axis 31 than the cutting portion 25' of the other blade member 27' is spaced from its rotational axis 31'. Additionally, the blade members 27 and 27' in the preferred embodiment are rotated at the same angular velocity about their respective axes 31 and 31' by the driven gear and pulley system 33 of FIG. 6. In this manner, the tangential velocity of the cutting portion 25 of the left blade member 27 in FIG. 7 is then greater than the tangential velocity of the cutting portion 25' of the right blade member 27' in FIG. 7. In the alternative, this desired differential in tangential velocities can be accomplished by mounting the blade members on identically sized collars and shafts and then simply using gearing (e.g., 2:1) to create the desired difference in tangential velocities. In such an alternate design, the rotational or angular velocities of the shafts would then also be different.

Figure 12:
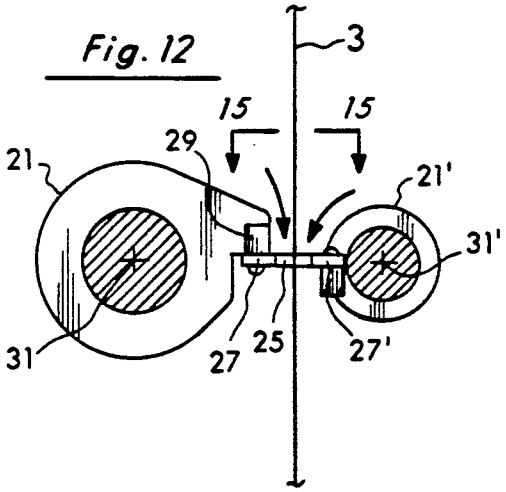
Figure 10:
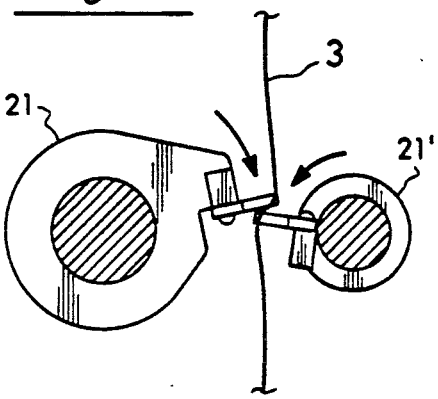
Figure 13:
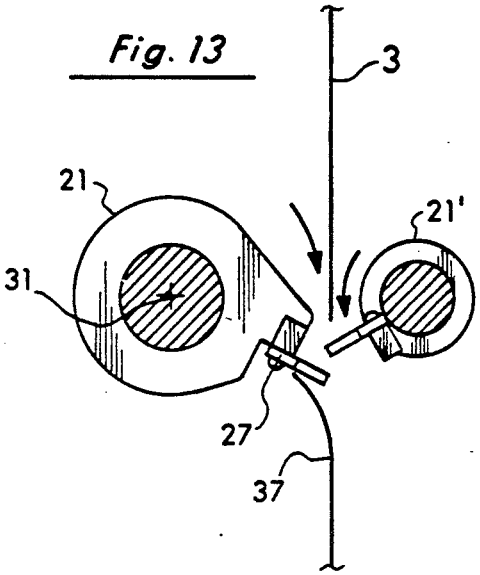
Figure 19:
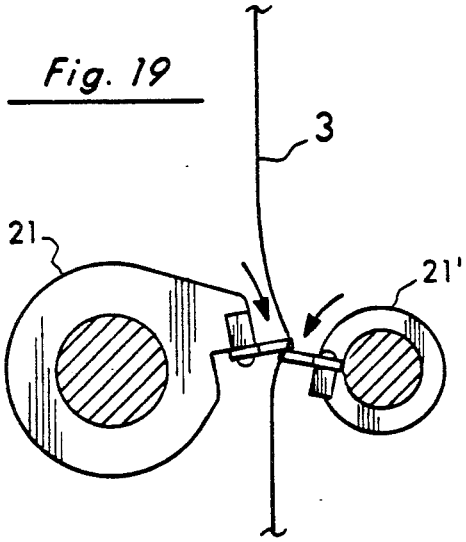

The actual cutting action involves feeding sheet 3 vertically downwardly along the planar path P between the axes of the rotating cutters 21 and 21' (FIG. 7). As the cutters 21 and 21' continue to rotate (FIG. 8), they arrive substantially simultaneously in the cutting area with the slower moving blade 27' (on the right side in FIG. 8) slightly ahead of the faster moving blade member 27. Both cutting portions 25 and 25' of the blade members 27 and 27' in the preferred embodiment are moved downwardly through the cutting area along arcuate paths that pass through the planar feed path P of the sheet 3. In this manner, as the cutting portions 25 and 25' approach one another in the cutting area (see FIG. 9), each cutting portion 25 and 25' will almost simultaneously contact and deflect adjacent parts of the sheet 3 in opposite horizontal directions. Thereafter, the faster moving cutting portion 25 will begin to catch up to the slower moving cutting portion 25'. In doing so, it will cause the tips of the teeth 35 (which are preferably pointed as shown in FIG. 16) of both cutting portions 25 and 25' to first puncture (FIG. 10) and then subsequently tear or shred (FIGS. 11 and 12) the sheet 3 horizontally in two as the cutting portions 25 and 25' overlap or mesh (FIG. 12) and pass through one another (FIG. 13). The action of the faster moving cutting portion 25 thereafter additionally serves to toss or direct the cut paper segment 37 to one side (i.e., to the left side in FIGS. 13 and 14) as blade member 27 continues along its path about its rotational axis 31. The cut segments or pieces 37 can then be collected in a bin or box 39 (see FIG. 5) and thereafter bailed and shipped for recycling.

As discussed above, the cutting action of the present invention preferably involves first puncturing the sheet 3 with the tips of teeth 35 of each cutting portion 25 and 25' (FIG. 10) and then subsequently tearing or shredding (FIGS. 11 and 12) the sheet in two as the cutting portions 25 and 25' overlap or mesh (FIG. 12) and pass through one another (FIG. 13). In puncturing sheet 3 in FIGS. 10 and 11, the cutting portions 25 and 25' in the preferred embodiment are both being moved tangentially faster along their downward, arcuate paths than the sheet 3 is being fed along its path P by gravity and rollers 23. In this manner, the cutting portions 25 and 25' will actually grip the free end of the sheet 3 and accelerate the sheet 3 to draw it taut against the resisting force of the feed rollers 23 of FIGS. 6 and 7. The upwardly directed resisting force of the rollers 23 is preferably greater than the downwardly directed force of the cutting portions 25 and 25'. In this manner, the sheet 3 is then placed under tension to enhance the subsequent tearing or shredding action. In the preferred embodiment, the planar blade members 27 and 27' are essentially aligned or coplanar when they mesh FIG. 12), with their rotational axes 31 and 31' being fixed, coplanar, and parallel to each other substantially in the same horizontal plane as the meshing blade members 27 and 27'. Additionally, as shown in FIG. 12, the horizontal plane of the meshing blade members 27 and 27' is preferably perpendicular to the vertical, sheet feeding path P.

Figure 21:
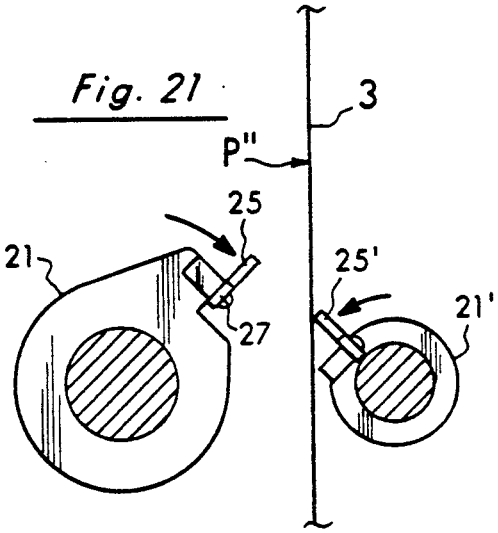
FIGS. 21–22 illustrate a third mode of operation of the present invention. In it, the sheet to be cut is fed downwardly out of or away from the rotational path of the left cutter in FIG. 21 wherein the right cutter will contact and push the sheet over to it as shown in FIG. 22. The subsequent cutting action then corresponds to that of FIGS. 9–14.
Figure 20:
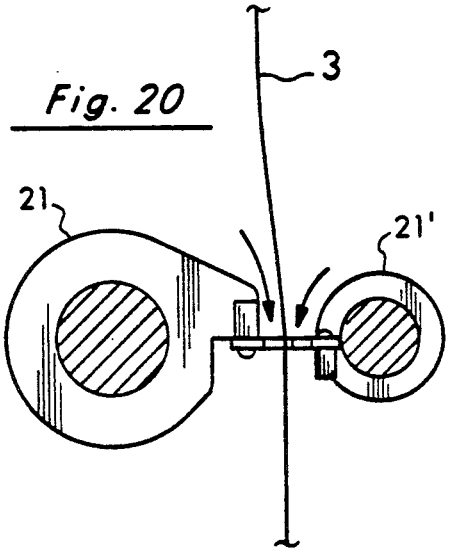
Figure 22:
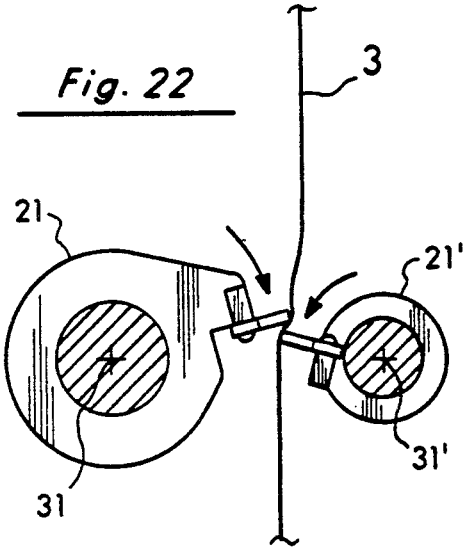

FIGS. 17-20 and FIGS. 21-22 illustrate second and third modes of operation of the present invention. In the mode of FIGS. 17-20, the sheet 3 is shown being fed downwardly along a planar path P' that is outside of or away from the rotational path of the cutting portion 25' of the right blade member 27' in FIG. 17. That is, the rotational path of the cutting portion 25' will not pass through the planar feed path P'. In the mode of FIGS. 21-22, the opposite situation is illustrated in which the sheet 3 is fed along a planar path P'' (see FIG. 21) that is outside of or away from the rotational path of the cutting portion 25 of the left blade member 27. These planar paths P' and P'' are in contrast to the preferred feed path P of FIGS. 7-8 which passes directly through the middle of the meshing cutting portions 25 and 25' (see FIG. 15). However, regardless of whether the feed path P' or P'' is outside of the rotational path of the left or right cutting portion 25 or 25', as long as it is between the axes of cutters 21 and 21' and as long as at least one of the cutting portions passes substantially through the sheet feeding path and the paths of the cutting portions overlap each other at a location substantially between the axes 31 and 31', the apparatus of the present invention will perform its basic cutting function in the preferred manner.

More specifically, as shown in FIGS. 17-20, if the feed path P' is out of the rotational path of the cutting portion 25' of the right blade member 27', then the cutting portion 25 of the left blade member 27 will contact and deflect a first part of the sheet 3 away from the planar feed path P' and axis 31 toward the axis 31' and into the rotational path of the cutting portion 25' of the right blade member 27'. The cutting portion 25' of the right blade member 27' will then deflect a second part of the sheet 3 away from the axis 31 in the manner of the preferred mode of operation of FIG. 9. The subsequent cutting action of the embodiment of FIGS. 18-20 then corresponds to that of the preferred mode of operation of FIGS. 9-14 wherein the vertically adjacent parts of the sheet 3 are cut from one another. Similarly, as shown in FIGS. 21-22, if the planar feed path P'' is out of the rotational path of the cutting portion 25 of the left blade member 27, then the cutting portion 25' of the right blade member 27' will contact and deflect a first part of the sheet 3 away from the path P'' toward the axis 31 and into the rotational path of the cutting portion 25 of the left blade member 27. The cutting portion 25 of the left blade member 27 will then deflect a second part of the sheet 3 in the manner of the preferred mode of operation of FIG. 9. The subsequent cutting action of the mode of FIGS. 21-22 then corresponds to that of FIGS. 9-14.

Referring again to FIG. 6, the cutting apparatus of the present invention preferably includes multiple pairs or sets (e.g., 3 sets) of blade members that are respectively spaced horizontally along and radially about the rotational axes 31 and 31' from each other. Each set of such blade members (see set 27 and 27' and set 39 and 39' in FIG. 6) functions the same except that they are, for example, spaced 120 degrees about their respective axes 31 and 31' from each other. In other words, the blade member 39 on the left in FIG. 6 is spaced not only horizontally along the axis 31 but also 120° about the axis 31 from the blade member 27. Similarly, the left blade member 39' in FIG. 6 is spaced horizontally along and 120° about the axis 31' from the blade member 27'. In this manner, the staggered pairs of blade members 27 and 27' and blade members 39 and 39' accomplish their cutting actions at different times to reduce the load on the operating motor and drive system 33. To accomplish this, the discharge end 19 of the overhead conveyor 15 is provided with overlapping, slitting disks 41 that vertically slit the incoming sheet 3 into separate sections (see FIG. 6). The separate sections are then cut into segment 43 by the left pair of blade members 39 and 39' and segment 37 by the right pair of blade members 27 and 27'.

While several embodiments of the invention have been shown and described in detail, it is to be understood that various modifications and changes could be made to them without departing from the scope of the invention. For example, the invention has been shown and described for use with planar sheets of paper such as sheet 3 and end caps 7; however, it is adaptable for use to cut a variety of other flexible materials.

We claim:

1. An apparatus primarily intended for cutting a substantially planar sheet of flexible material such as paper into segments, said apparatus including:

means for feeding said sheet of paper substantially vertically downward substantially along a planar path, and means for making a substantially horizontal cut across said downwardly fed sheet to cut said sheet into segments, said cut making means including:

a first blade member with a sawtoothed, cutting portion, a second blade member with a sawtoothed, cutting portion, means for mounting said first blade member for rotation about a first axis with the cutting portion thereof spaced from said first axis, means for mounting said second blade member for rotation about a second axis with the cutting portion thereof spaced from said second axis, said second axis being spaced from said first axis and said feeding means feeding said sheet downwardly along said planar path between said first and second axes at a first velocity, means for rotating said first blade member about said first axis with the cutting portion thereof moving downwardly about said first axis along an arcuate path substantially passing through said planar sheet feeding path at a location substantially between said first and second axes, and means for rotating said second blade member about said second axis with the cutting portion thereof moving downwardly about said second axis along an arcuate path overlapping the arcuate path of the cutting portion of the first blade member at a location substantially between said first and second axes at substantially the same time said cutting portion of said first blade member passes through said planar sheet feeding path wherein said cutting portions contact and horizontally cut said sheet of paper into segments, said respective rotating means for said first and second blade members rotate the respective cutting portions of said first and second blade members about the respective first and second axes at respective tangential velocities greater than the first velocity said feeding means feeds said sheet downwardly along said sheet feeding path, said sawtoothed cutting portions of said first and second blade members having teeth wherein the teeth of the cutting portion of the first blade member and the teeth of the cutting portion of the second blade member mesh when the arcuate paths of the cutting portions of said first and second blade members overlap.

2. The apparatus of claim 1 wherein said teeth of the first and second blade members are pointed and the points thereof puncture said sheet substantially as the arcuate paths of the cutting portions of said rotating first and second blade members overlap.

3. The apparatus of claim 1 further including:

a third blade member with a cutting portion, means for mounting such third blade member for rotation about said first axis with the cutting portion thereof spaced from said first axis and with said third blade member spaced along said first axis from said first blade member and spaced radially about said first axis from said first blade member, and means for rotating said third blade member about said first axis with the cutting portion thereof moving about said first axis along a path substantially passing through said planar sheet feeding path at a location substantially between said first and second axes, and a fourth blade member with a cutting portion, means for mounting said fourth blade member for rotation about said second axis with the cutting portion thereof spaced from said second axis and with said fourth blade member spaced along said second axis from said second blade member and spaced radially about said second axis from said second blade member, and means for rotating said fourth blade member about sad second axis with the cutting portion thereof moving about said second axis along a path overlapping the path of said cutting portion of said third blade member at a location substantially between said first and second axes at substantially the same time said cutting portion of said third blade member passes through said planar sheet feeding path wherein said cutting portions contact and cut said sheet.

4. The apparatus of claim 3 wherein said third and fourth blade members are horizontally spaced from said first and second blade members and said apparatus further included means for vertically slitting said sheet into first and second sections, said feeding means feeding said first section between said first and second blade members and said feeding means feeding said second section between said third and fourth blade members.

5. The apparatus of claim 1 wherein the respective rotating means for said first and second blade members rotate the respective first and second blade members about the respective first and second axes at the same angular velocity.

6. The apparatus of claim 5 wherein the cutting portion of said second blade member is spaced farther from said second axis than the cutting portion of said first blade member is spaced from the first axis wherein the tangential velocity of the cutting portion of said second blade member about the second axis is greater than the tangential velocity of the cutting portion of the first blade member about the first axis.

7. The apparatus of claim 1 wherein the cutting portion of said second blade member is spaced farther from said second axis than the cutting portion of said first blade member is spaced from the first axis.

8. The apparatus of claim 1 wherein said first and second axes are parallel to each other.

9. The apparatus of claim 1 wherein said first and second axes are coplanar.

10. The apparatus of claim 1 wherein said first and second axes are fixed relative to each other.

11. The apparatus of claim 1 wherein said feeding means feeds said sheet by gravity substantially vertically downwardly between said first and second axes.

12. The apparatus of claim 1 wherein the arcuate path of the cutting portion of said second blade member substantially passes through said planar sheet feeding path.

13. The apparatus of claim 1 wherein said cutting portions contact and exert a downward first force on said sheet as said cutting portions respectively are moved along said arcuate paths and said feeding means includes means for exerting a second force on said sheet in an upward direction substantially opposite to said first force whereby said sheet is placed under tension.

14. The apparatus of claim 13 wherein said second force is greater than said first force.

15. The apparatus of claim 1 wherein said rotating means for said second blade member rotates said cutting portion thereof along said arcuate path about said second axis at a higher tangential velocity than said rotating means for said first blade member rotates said cutting portion thereof along said arcuate path about said first axis.

16. The apparatus of claim 15 wherein the respective rotating means for said first and second blade members rotate the respective first and second blade members about the respective first and second axes at the same angular velocity.

17. The apparatus of claim 16 wherein the cutting portion of said second blade member is spaced farther from said second axis than the cutting portion of said first blade member is spaced from the first axis.

18. The apparatus of claim 1 wherein said first and second blade members are substantially planar and substantially coplanar when the arcuate paths of the cutting portions of sad blade members overlap.

19. The apparatus of claim 18 wherein said first and second blade members are substantially coplanar in a substantially horizontal plane when the arcuate paths of the cutting portions of said blade members overlap.

20. The apparatus of claim 1 wherein said first and second blade members are substantially perpendicular to the planar sheet feeding path when the arcuate paths of said cutting portions of said first and second blade members overlap.

21. A method primarily intended for cutting a substantially planar sheet of flexible material such as paper into segments, said method including the steps of:

(a) providing a first blade member with a sawtoothed, cutting portion having a plurality of pointed teeth, (b) providing a second blade member with a sawtoothed, cutting portion having a plurality of pointed teeth, (c) feeding said sheet of paper substantially vertically downwardly substantially along a planar path, (d) moving the cutting portion of said first blade member downwardly about a first axis along an arcuate path substantially passing through said planar sheet feeding path to contact and deflect a first path of said sheet away from said planar sheet feeding path in a first direction substantially away from said first axis, (e) moving the cutting portion of said second blade member downwardly about a second axis along an arcuate path overlapping the arcuate path of the cutting portion of said first blade member to contact and deflect a second part of said sheet in a direction substantially opposite to said first direction and substantially away from said second axis, said first and second parts of said sheet being attached to and vertically adjacent one another, (f) puncturing said respective first and second sheet parts with the respective, pointed teeth of the cutting portions of the first and second blade members, said cutting portions being moved downwardly faster than said downwardly fed sheet wherein said cutting portions accelerate said sheet as said respective pointed teeth of said cutting portions puncture said respective first and second sheet parts, and (g) continuing to move said cutting portions of said first and second blade members among the respective arcuate paths about the respective first and second axes to a substantially overlapping position substantially between said first and second axes to cut said sheet into segments substantially between said first and second sheet parts.

22. The method of claim 21 wherein the cutting portion of said second blade member of steps (e) and (g) is moved faster along said arcuate path thereof than the cutting portion of said first blade member of steps (d) and (g) is moved along said arcuate path thereof.

23. The method of claim 21 further including the limitation in step (g) of overlapping said cutting portions in a meshing relationship.

24. The method of claim 21 wherein step (g) includes the further limitation of cutting said sheet horizontally between said first and second sheet parts.

25. The method of claim 21 wherein step (e) includes the further limitation of moving the cutting portion of said second blade about said second axis along said arcuate path wherein said arcuate path substantially passes through said planar sheet feeding path to contact and deflect said second sheet part away from said planar sheet feeding path.

26. The method of claim 21 including the further limitation of performing steps (d) and (e) substantially simultaneously.

27. The method of claim 21 wherein the cuting portion of one of said first and second blade members of steps (d)–(g) is moved faster along said arcuate path thereof than the cutting portion of the other blade member of steps (d)–(g) is moved along said arcuate path thereof.

* * * * *